US005338919A

United States Patent [19]

Tagashira et al.

[11] Patent Number: 5,338,919

[45] Date of Patent: Aug. 16, 1994

[54] HEATER FOR SHEET MATERIAL AND METHOD FOR ADJUSTING RESISTANCE OF SAME

[75] Inventors: Fumiaki Tagashira; Shigeo Ota; Shinya Yukawa; Shingo Ooyama, all of Kyoto, Japan

[73] Assignee: Rohm Co., Ltd., Kyoto, Japan

[21] Appl. No.: 993,668

[22] Filed: Dec. 21, 1992

[30] Foreign Application Priority Data

Dec. 28, 1991 [JP] Japan ..... 3-359320
Dec. 28, 1991 [JP] Japan ..... 3-359327

[51] Int. Cl.[5] ..... H05B 3/16

[52] U.S. Cl. ..... 219/543; 219/539; 219/216; 338/309

[58] Field of Search ..... 338/320, 306, 125, 76, 338/92, 202, 289, 295, 307, 308, 309; 219/216, 543, 539

[56] References Cited

U.S. PATENT DOCUMENTS

| | | | |
|---|---|---|---|
| 2,629,166 | 2/1953 | Marsten et al. | 338/325 |
| 3,621,441 | 11/1971 | Hudnall et al. | 338/195 |
| 4,912,306 | 3/1990 | Grise et al. | 219/543 |
| 5,068,517 | 11/1991 | Tsuyuki et al. | 219/216 |

FOREIGN PATENT DOCUMENTS

| | | | |
|---|---|---|---|
| 0286217 | 9/1988 | European Pat. Off. | 219/543 |
| 0190102 | 8/1991 | Japan | 338/306 |
| 0190103 | 8/1991 | Japan | 338/306 |

*Primary Examiner*—Bruce A. Reynolds
*Assistant Examiner*—Gregory Mills
*Attorney, Agent, or Firm*—William H. Eilberg

[57] ABSTRACT

A heater for a sheet material comprises an insulating substrate, and a plurality of heating resistor strips formed on the substrate to extend in parallel to each other between first and second common electrodes. At least one of the resistor strips is electrically connected to both of the first and second common electrodes while at least another of the resistor strips is electrically separated from the first common electrode.

13 Claims, 9 Drawing Sheets

HEATER FOR SHEET MATERIAL AND METHOD FOR ADJUSTING RESISTANCE OF SAME

BACKGROUND OF THE INVENTION

1. Field of the Invention

This invention relates generally to heaters. More specifically, the present invention relates to a linear heater which can be advantageously used in an office automation apparatus such as a photocopier or electrophotographic printer for fixing images on a paper sheet for example. The present invention also relates to a method for adjusting the resistance of such a heater.

2. Description of the Prior Art

Various types of linear heaters are known for fixing images (deposited toner) on a paper sheet in photocopiers or electrophotographic printers (e.g. laser beam printer). Typical examples include a lamp heater and a roller heater.

However, the lamp heater and roller heater are equally disadvantageous in that there is a limitation in reducing size (thickness) and cost. Further, the lamp heater is easily damaged due to the nature of material, whereas the roller heater has a complicated structure due to the necessity of incorporating plural heating elements within the roller.

To eliminate the problems of the conventional heaters, it has been proposed to use a strip heater for fixing images on a paper sheet in electrophotography, as disclosed in U.S. Pat. No. 5,068,517 for example. Specifically, the strip heater disclosed in this U.S. patent comprises an elongate insulating substrate having a surface formed with a printed resistor strip. Each end of the resistor strip is connected to an enlarged terminal electrode made of silver for connection to a power source. The resistor strip, which is made of e.g. silver-palladium alloy, generates heat when a current is passed therethrough.

Obviously, the prior art strip heater is very simple in arrangement. Further, the strip heater can be made very thin and light by reducing the thickness of the substrate. Moreover, the strip heater is also advantageous in that the time required for warming up is very short. However, the prior art strip heater still has the following problem.

According to the prior art, a resistor strip is formed by printing a resistor material paste (e.g. silver-palladium) on a substrate and baking the printed paste for fixation. Obviously, it is necessary to print a resistor material paste and bake the printed paste equally (uniformly) for all heaters of the same specification, thereby insuring a uniform quality.

However, the composition and viscosity of the resistor material paste tend to vary inevitably upon every change from one lot (batch) to another. Further, it is difficult to print the material paste with uniform thickness and width for all heaters, as also is to realize strictly uniform baking conditions. Thus, different heaters of the same specification tend to have different heating characteristics.

SUMMARY OF THE INVENTION

It is, therefore, an object of the present invention to provide a heater wherein the electrical resistance across a pair of electrodes can be conveniently adjusted.

Another object of the present invention is to provide a method for conveniently adjusting the resistance of a heater.

According to one aspect of the present invention, there is provided a heater for a sheet material comprising: an insulating substrate; and a plurality of heating resistor strips formed on the substrate to extend side by side between first and second common electrodes; wherein at least one of the resistor strips is electrically connected to both of the first and second common electrodes while at least another of the resistor strips is electrically separated from the first common electrode.

According to another aspect of the present invention, there is provided a method for adjusting resistance of a heater for a sheet material, the heater comprising: an insulating substrate; and a plurality of heating resistor strips formed on the substrate to extend side by side between first and second common electrodes, all of the resistor strips being initially connected electrically to both of the first and second electrodes; the method comprising: while measuring the resistance across the first and second common electrodes, electrically separating at least selected one of the resistor strips from the first common electrode until the measured resistance reaches a predetermined value.

The present invention also provides a method for adjusting resistance of a heater for a sheet material, the heater comprising: an insulating substrate; and a plurality of heating resistor strips formed on the substrate to extend side by side between first and second common electrodes, all of the resistor strips being initially separated electrically at least from the first electrode; the method comprising: electrically connecting at least selected one of the resistor strips to the first common electrode to obtain a predetermined resistance across the first and second common electrodes.

Other objects, features and advantages of the present invention will become apparent from the following detailed description of the preferred embodiments given with reference to the accompanying drawings.

DETAILED DESCRIPTION OF THE PREFERRED EMBODIMENTS

Figure 1:
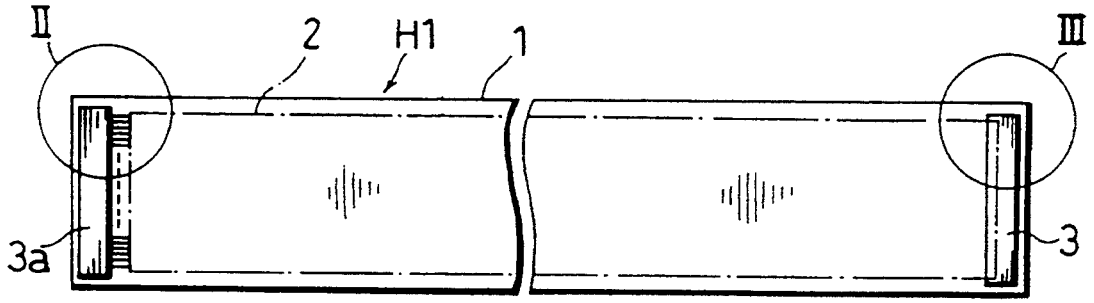
FIG. 1 is a schematic plan view showing a heater according to a first embodiment of the present invention.

Preferred embodiments of the present invention are now described with reference to FIGS. 1 through 12 of the accompanying drawings. In these figures, like parts are designated by like reference numerals and characters.

EMBODIMENT 1

FIGS. 1–5 show a heater according to a first embodiment of the present invention.

Referring first to FIGS. 1–4, the heater H1 of this embodiment comprises an elongate substrate 1 made of a heat-resistant insulating material such as ceramic. The substrate has a top surface formed with a plurality of heating resistor strips 2 extending in parallel to each other longitudinally of the substrate 1. Further, the top surface of the substrate carries a pair of common electrodes 3, 3*a* extending transversely of the substrate at both ends thereof.

In the first embodiment, the respective resistor strips 2 are spaced transversely from each other at a constant pitch and have a same width. The resistor strips 2 may be made simultaneously by printing silver-palladium paste with the use of a suitable screen or mask and then baking the paste for fixation. Similarly, the respective common electrodes 3, 3*a* may be made by printing silver paste and then baking the paste for fixation. Obviously, the resistor strips 2 may be made of any other suitable resistor material such as ruthenium oxide, whereas the common electrodes 3, 3*a* may be made of any other suitable conductor material such as copper or gold.

Figure 2:
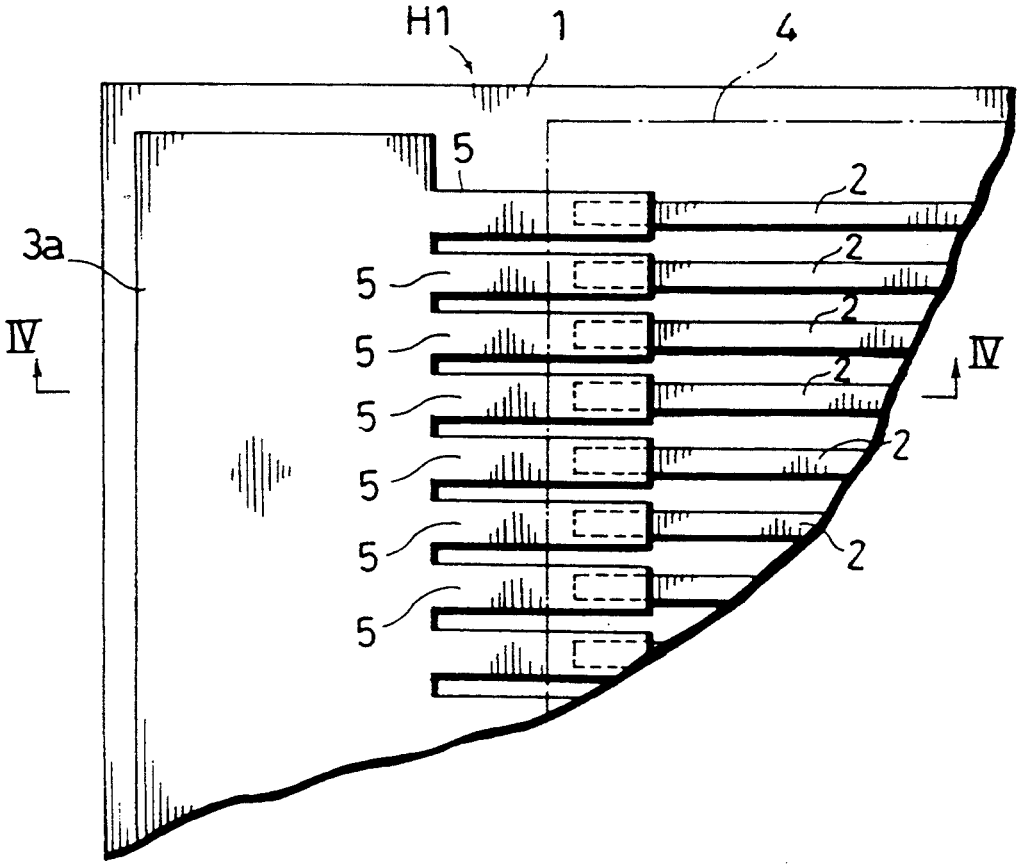
FIG. 2 is an enlarged fragmentary plan view showing a portion of the same heater indicated by a circle II in FIG. 1.
Figure 3:
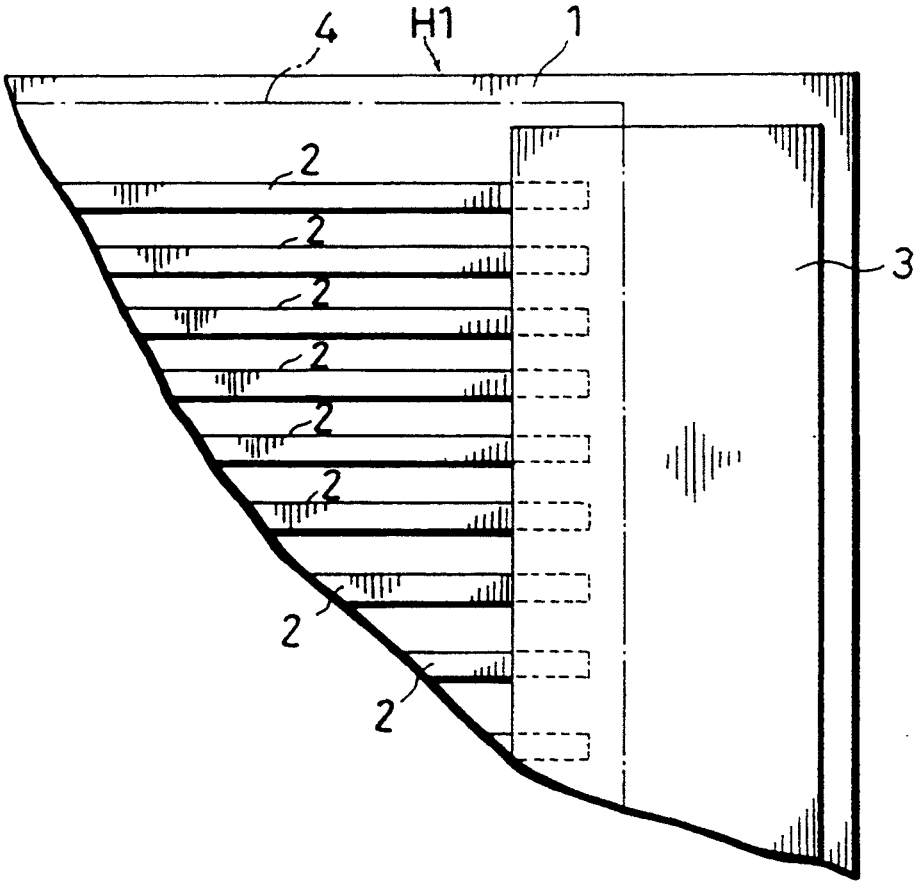
FIG. 3 is an enlarged fragmentary plan view showing a portion of the same heater indicated by another circle III in FIG. 1.

One common electrode 3 (right electrode in FIG. 1) is laid partially over the respective resistor strips 2 for direct electrical connection thereto, as shown in FIG. 3. The other common electrode 3*a* (left electrode in FIG. 1) has a plurality of comb-like teeth 5 which are initially connected electrically to all of the resistor strips 2, as shown in FIG. 2. The number and pitch of the comb-like teeth 5 correspond respectively to those of the resistor strips 2.

Figure 4:
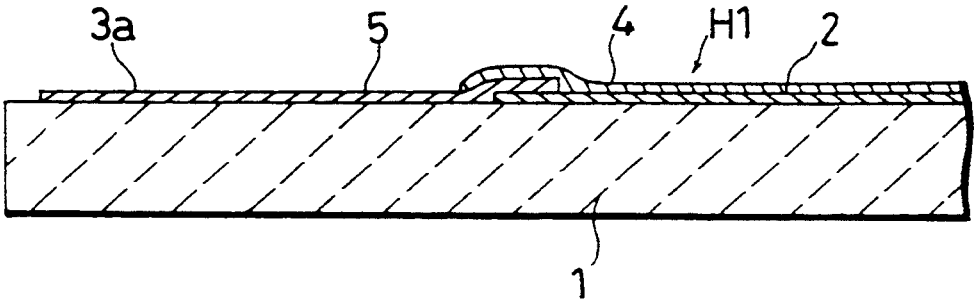
FIG. 4 is a fragmentary sectional view taken along lines IV—IV in FIG. 2.

A protective glass coating 4 covers the entirety of the respective resistor strips 2 and part of the right common electrode 3 (see FIG. 3), whereas the left common electrode 3*a* is entirely exposed (see FIGS. 2 and 4). The exposed portion of the right electrode 3 and any portion of the left electrode 3*a* are used for electrically connecting respectively to power supply lines (not shown).

With the arrangement described above, the overall resistance of the heater HI is adjusted in the following manner.

Figure 5:
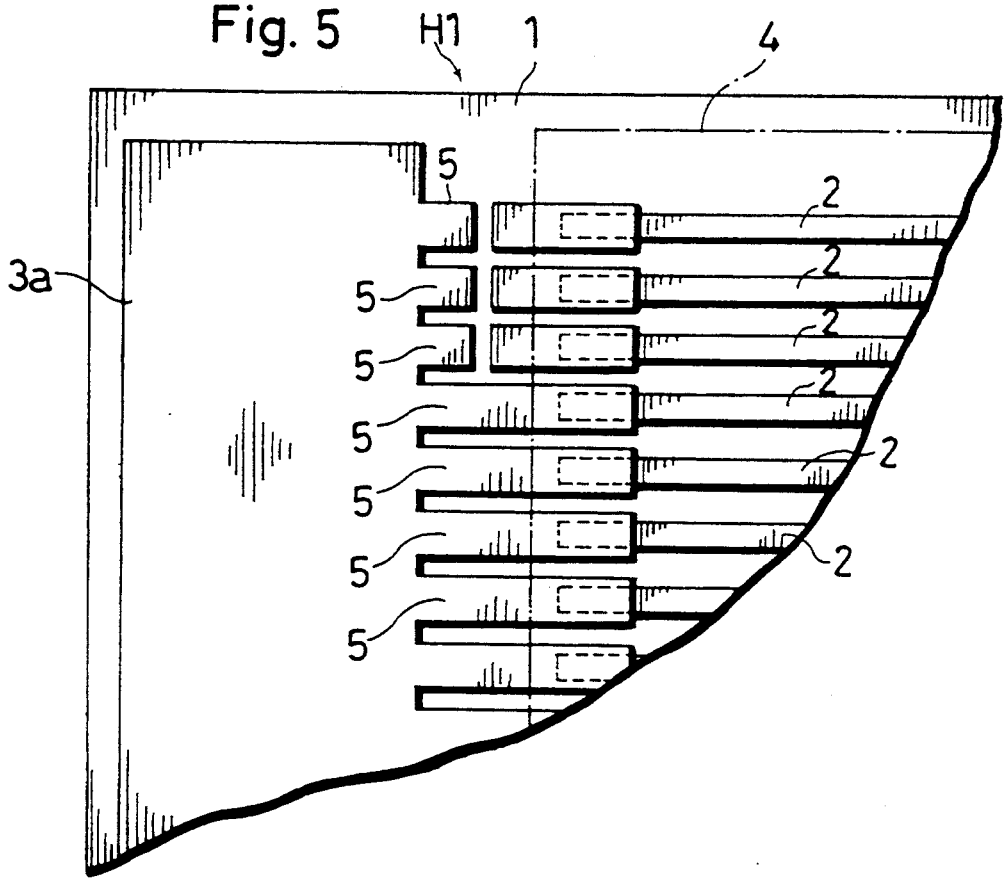
FIG. 5 is an enlarged fragmentary plan view similar to FIG. 2 but showing the same heater after resistance adjustment.

When all of the resistor strips 2 are electrically connected to the respective common electrodes 3, 3*a* (see FIGS. 2 and 3 ), the heater H1 provides a minimum combined resistance. In this initial condition, detection probes (not shown) are brought into contact with the respective common electrodes 3, 3*a* for resistance determination. Then, the comb-like teeth 5 are severed selectively and successively for resistance adjustment, as shown in FIG. 5. Severing of the comb-like teeth 5 may be performed by applying a laser beam or by mechanical material removal for example.

The overall resistance of the heater H1 increases as the number of disconnected resistor strips 2 increases. Severing of the comb-like teeth 5 is terminated when a desired resistance is reached. Obviously, an incremental step of the resistance obtainable by disconnecting one resistor strip reduces as the total number of the resistor strips 2 increases, thus providing finer resistance adjustment.

According to the first embodiment shown in FIGS. 1–5, the protective glass coating 4 covers only part of the comb-like teeth 5 (see FIGS. 2 and 5). With such an arrangement, selective severing of the comb-like teeth 5 for resistance adjustment may be performed either before or after forming the protective glass coating 4. Further, such resistance adjustment may be performed either by the heater manufacturer or user.

EMBODIMENT 2

Figure 6:
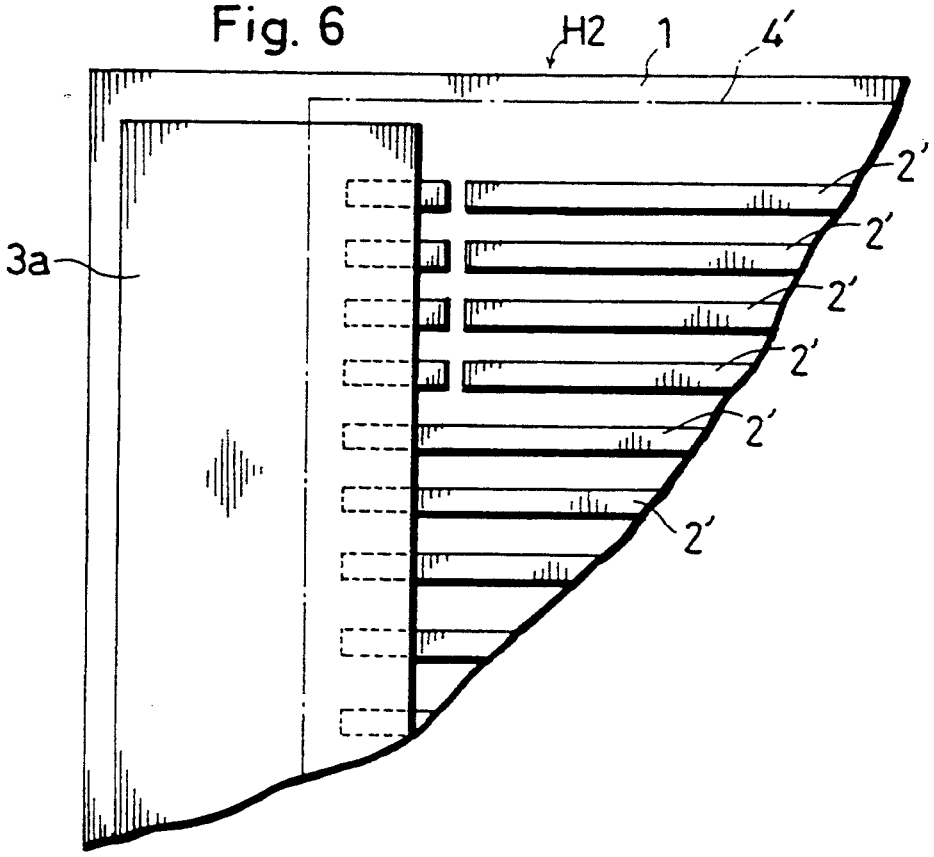
FIG. 6 is a fragmentary plan view similar to FIG. 2 but showing a principal portion of a heater according to a second embodiment of the present invention.

FIG. 6 shows a heater according to a second embodiment of the present invention.

Similarly to the foregoing embodiment, the heater H2 of the second embodiment comprises an elongate insulating substrate 1, a plurality of heating resistor strips 2′, and a protective glass coating 4′. However, all of the resistor strips 2′ are initially connected directly to a left common electrode 3*a* ( as well as to an unillustrated right common electrode), and selected one or ones of the resistor strips 2′ are successively severed near the left common electrode 3*a* for resistance adjustment. Severing of the selected resistor strips may be conducted by using a laser beam for example while measuring the overall resistance of the heater H2.

According to the second embodiment of FIG. 6, the protective coating 4′ covers the entirety of the resistor strips 2′. Thus, severing of the selected resistor strips 2′ should be performed by the heater manufacturer before forming the protective coating 4′.

The advantage of the second embodiment resides in the omission of comb-like teeth for establishing electrical connection between the respective resistor strips 2′ and the left common electrode 3*a*. Thus, the configuration of the heater H2 can be simplified to reduce the manufacturing cost.

EMBODIMENT 3

Figure 7:
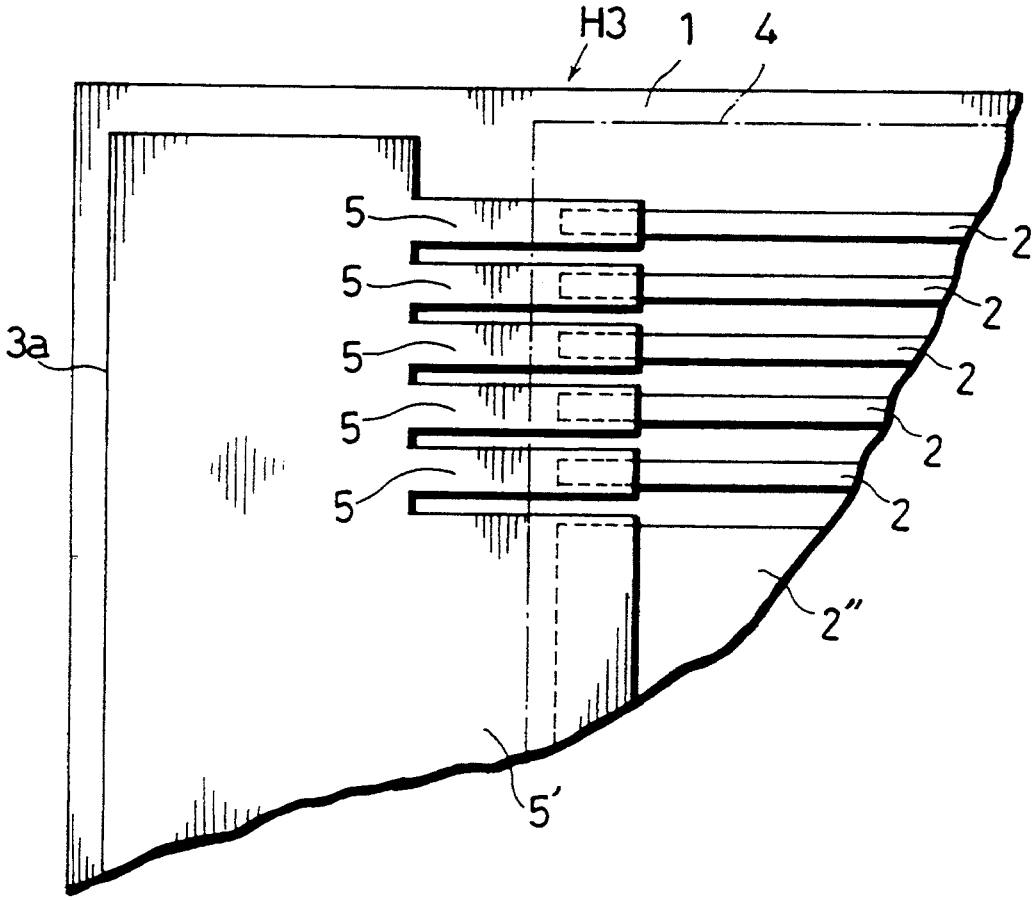
FIG. 7 is a fragmentary plan view similar to FIG. 2 but showing a principal portion of a heater according to a third embodiment of the present invention.
Figure 8:
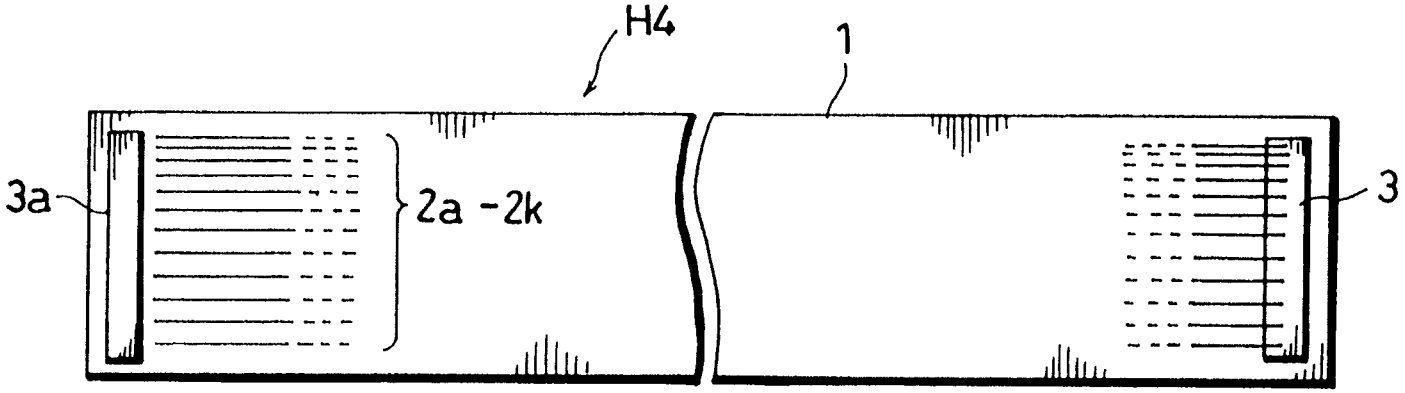
FIG. 8 is a schematic plan view similar to FIG. 1 but showing a heater according a fourth embodiment of the present invention.

FIG. 7 shows a heater according to a third embodiment of the present invention. The heater H3 of this embodiment differs from that of the first embodiment (FIGS. 1–5) only in the following points.

Specifically, the heater H3 of the third embodiment comprises a wider main resistor strip 2″ and a plurality of narrower resistor strips 2. The main resistor strip 2″ is always connected electrically to a left common electrode 3*a* (as well as to an unillustrated right common electrode) via a corresponding connector portion 5′. The left common electrode 3*a* further has a plurality of comb-like teeth 5 for initial connection to the respective narrower resistor strips 2. Resistance adjustment is performed by severing selected one or ones of the comb-like teeth 5 (as indicated by phantom lines) while measuring the overall resistance of the heater H3.

In the third embodiment, the comb-like teeth 5 and connector portion 5′ of the left common electrode 3*a* may be omitted. In this case, the main resistor strip 2″ and the narrower resistor strip 2 are made to extend enough for direct connection to the left common electrode 3a (cf. FIG. 6).

EMBODIMENT 4

FIGS. 9–12 show a heater according to a fourth embodiment of the present invention.

Referring first to FIGS. 1–4, the heater H4 of this embodiment comprises an elongate substrate 1 made of a heat-resistant insulating material such as ceramic. The substrate has a top surface formed with a plurality of heating resistor strips 2a–2k extending in parallel to each other longitudinally of the substrate 1. Further, the top surface of the substrate carries a pair of common electrodes 3, 3a extending transversely of the substrate at both ends thereof.

In the fourth embodiment, the width of the respective resistor strips increases stepwise from the resistor strip 2a located nearest one longitudinal edge of the substrate 1 to the resistor strip 2k located nearest the other longitudinal edge of the substrate 1. The resistor strips 2a–2k may be made simultaneously by printing silver-palladium paste with the use of a suitable screen or mask and then baking the paste for fixation. Obviously, the resistor strips may be made of any other suitable resistor material such as ruthenium oxide.

One common electrode 3 (right electrode in FIG. 9) is laid partially over the respective resistor strips 2a–2k for direct electrical connection thereto. The other common electrode 3a ( left electrode in FIG. 9 ) is initially separated electrically from all of the resistor strips 2a–2k. The respective common electrodes 3, 3a may be made by printing silver paste and then baking the paste for fixation. Obviously, the common electrodes 3, 3a may be made of any other suitable conductor material such as copper or gold.

Figure 9:
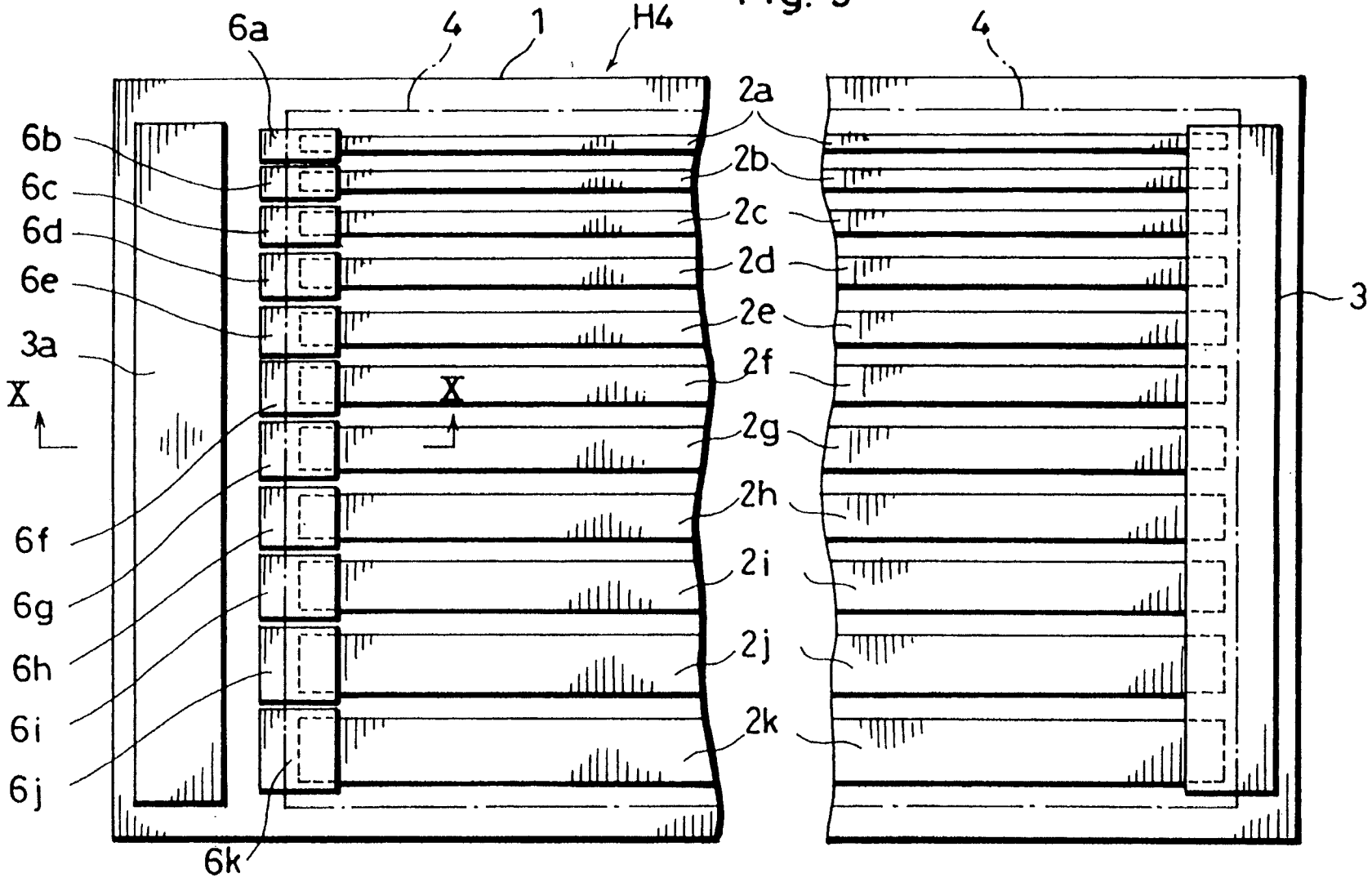
FIG. 9 is an enlarged plan view showing the heater of FIG. 8 before resistance adjustment.
Figure 10:
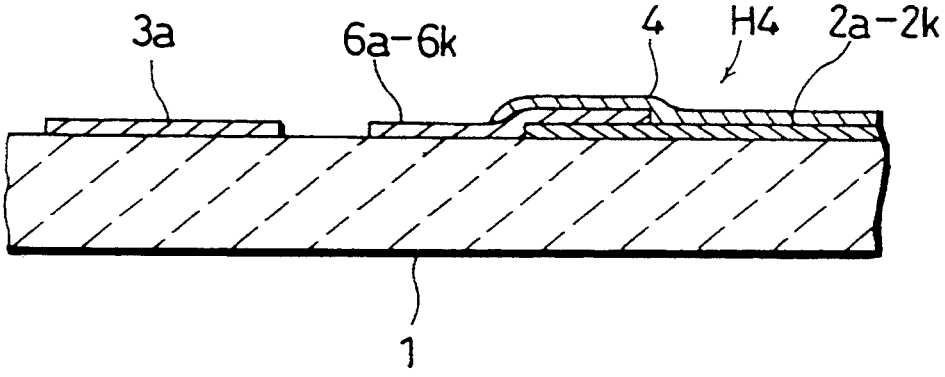
FIG. 10 is a fragmentary sectional view taken along lines X—X in FIG. 9.

On the other hand, the resistor strips 2a–2k are electrically connected to respective conductor pads 6a–6k near the left common electrode 3a. A protective glass coating 4 covers the entirety of the respective resistor strips 2a–2k and part of the right common electrode 3 and respective conductor pads 6a–6k, whereas the left common electrode 3a is entirely exposed, as shown in FIG. 9. The exposed portion of the right electrode 3 and any portion of the left electrode 3a are used for electrically connecting respectively to power supply lines (not shown). Further, the exposed portions of the respective conductor pads 6a–6k are used for electrical connection to the left common electrode 3a, as described below.

Figure 11:
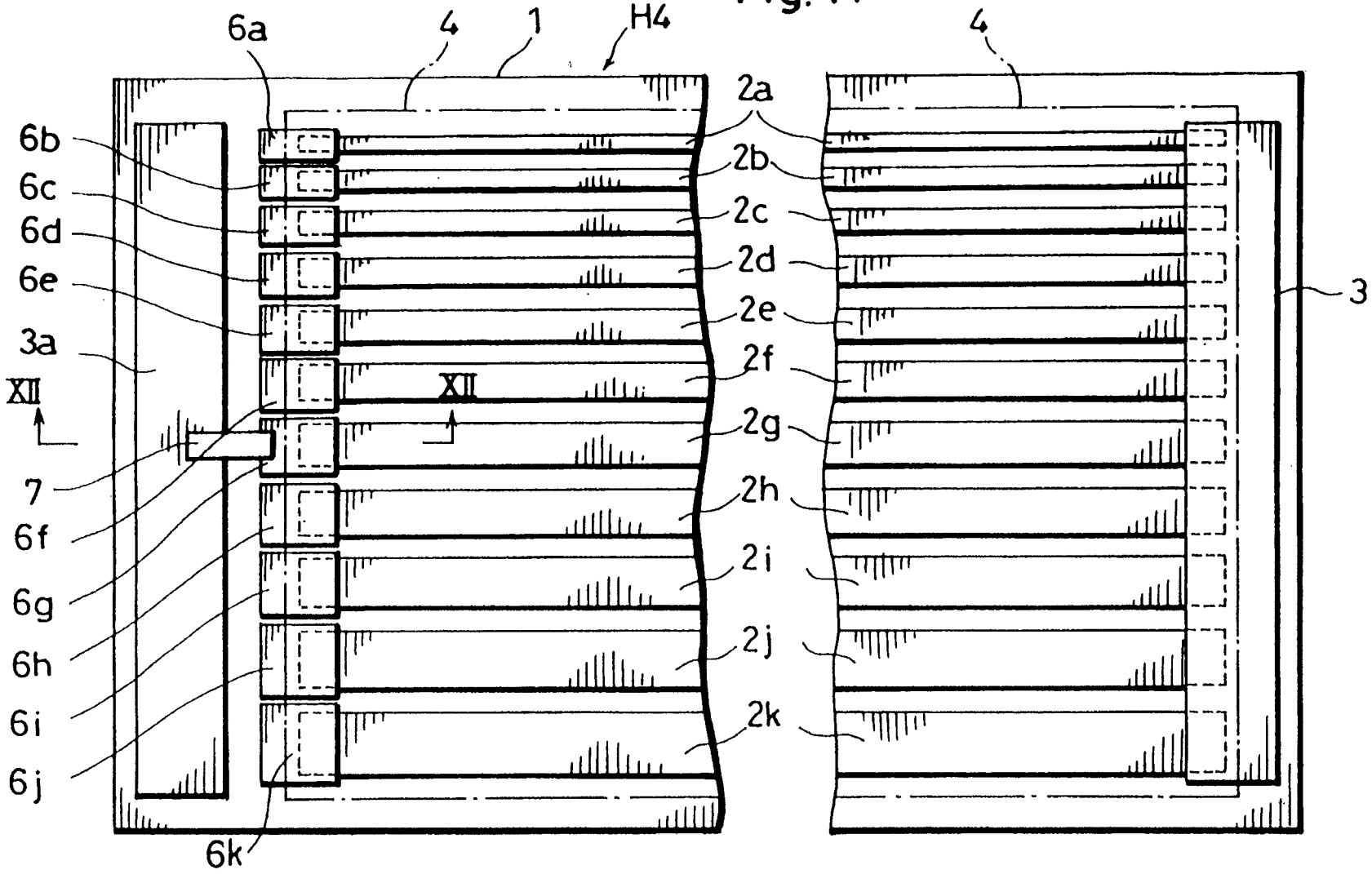
FIG. 11 is an enlarged plan view similar to FIG, 9 but showing the same heater after resistance adjustment.
Figure 12:
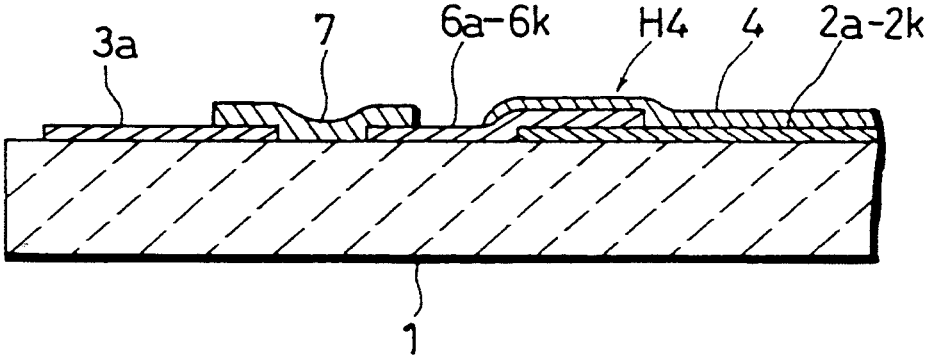
FIG. 12 is a fragmentary sectional view taken along lines XII—XII in FIG. 11.

With the arrangement described above, selected one of the resistor strips 2a–2k is determined for its resistance by bringing probes (not shown) into contact with the right common electrode 3 and a relevant one of the conductor pads 6a–6k. If the determined resistance is acceptable, the selected resistor strip (e.g. 2g) is electrically connected to the left common electrode 3a via a conductor strip 7 which may be made of high melting point solder for example, as shown in FIGS. 11 and 12. Of course, if the determined resistance is unacceptable, resistance determination is repeated with respect to the other resistor strips until a desired resistance is obtained.

Preferably, a most likely candidate resistor strip (e.g. 2g) may be arranged at the transverse center of the substrate 1. In this case, resistance determination is started from this central resistor strip 2g. If the determined resistance is lower than a desired value, the progressively narrower resistor strips 2a–2f are tried. If the determined resistance is higher than a desired value, the progressively wider resistor strips 2h–2k are tested.

Obviously, two or more of the resistor strips 2a–2k may be electrically connected to the left common electrode 3a as required for obtaining a desired overall resistance. Further, the conductor strip 7 may be replaced by a conductor wire.

According to the fourth embodiment shown in FIGS. 9–12, the protective glass coating 4 covers only part of the conductor pads 6a–6k (see FIG. 11). With such an arrangement selective formation of the conductor strip 7 for resistance adjustment may be performed either before or after forming the protective glass coating 4. Further, such resistance adjustment may be performed either by the heater manufacturer or user.

As described above in connection with the four embodiments, the present invention is based on the fact that the resistance of a single resistor strip often deviates from a desired value due to various factors which include variations in composition and viscosity of a resistor paste and in thickness and baking temperature of the applied resistor paste. On this basis, the present invention proposes to form a plurality of candidate resistor strips on a single substrate and then select one or any combination of the resistor strips, thereby achieving a desired resistance.

The present invention being thus described, it is obvious that the same may be varied in many ways. For instance, any heater according to the present invention may be used for heat-sealing a thermoplastic sheet in addition to image fixation. Further, while all of the resistor strips are always connected to the right common electrode 3 according to any of the illustrated embodiments, these resistor strips may be selectively connected to the right common electrode 3 in addition to or in place of the left common electrode 3a. Such variations are not to be regarded as a departure from the spirit and scope of the the invention, and all such modifications as would be obvious to those skilled in the art are intended to be included within the scope of the following claims.

We claim:

1. A heater for a sheet material comprising:
an electrically insulating substrate; and
a plurality of resistor strips formed on the substrate to extend side by side between first and second electrodes;
wherein at least one of the resistor strips is electrically connected to both of the first and second electrodes while at least another of the resistor strips is electrically separated from the first electrode; and
wherein the first electrode has a plurality of integral comb-like teeth, at least one of the comb-like teeth being severed between the first electrode and said at least another resistor strip.

2. The heater according to claim 1, wherein all of the resistor strips are electrically connected directly to the second electrode.

3. The heater according to claim 1, wherein all of the resistor strips are substantially equal in width.

4. A heater for a sheet material comprising:
an electrically insulating substrate; and
a plurality of resistor strips formed on the substrate to extend side by side between first and second electrodes;
wherein at least one of the resistor strips is electrically connected to both of the first and second electrodes while at least another of the resistor strips is electrically separated from the first electrode; and wherein said at least another resistor strip is severed adjacent to the first electrode.

5. A heater for a sheet material comprising:

an electrically insulating substrate; and a plurality of resistor strips formed on the substrate to extend side by side between first and second electrodes;

wherein at least one of the resistor strips is electrically connected to both of the first and second electrodes while at least another of the resistor strips is electrically separated from the first electrode; and wherein the resistor strips include a wider main resistor strip as said at least one resistor strip and a plurality of narrower resistor strips, said at least another resistor strip is selected form the narrower resistor strips.

6. A heater for a sheet material comprising:

an electrically insulating substrate; and a plurality of resistor strips formed on the substrate to extend side by side between first and second electrodes;

wherein at least one of the resistor strips is electrically connected to both of the first and second electrodes while at least another of the resistor strips is electrically separated from the first electrode; and wherein said at least one resistor strip is electrically connected to the first electrode via a conductor member.

7. The heater according to claim 6, wherein the conductor member is made of high melting point solder.

8. The heater according to claim 6, wherein each of the resistor strips is connected to a conductor pad which is located adjacent to but spaced from the first electrode.

9. The heater according to claim 6, wherein the respective resistor strips are different in width.

10. A method of adjusting resistance of a heater for a sheet material, the heater comprising: an electrically insulating substrate; and a plurality of resistor strips formed on the substrate to extend side by side between first and second electrodes, all of the resistor strips being initially connected electrically to both of the first and second electrodes; the method comprising:

while measuring the resistance across the first and second electrodes, electrically separating at least selected one of the resistor strips from the first electrode so that the measured resistance reaches a predetermined value;

wherein the first electrode has comb-like teeth for initial electrical connection to the respective resistor strips, the electrical separation being performed by severing at least selected one of the comb-like teeth.

11. A method of adjusting resistance of a heater for a sheet material, the heater comprising: an electrically insulating substrate; and a plurality of resistor strips formed on the substrate to extend side by side between first and second electrodes, all of the resistor strips being initially connected electrically to both of the first and second electrodes; the method comprising:

while measuring the resistance across the first and second electrodes, electrically separating at least selected one of the resistor strips from the first electrode so that the measured resistance reaches a predetermined value;

wherein the respective resistor strips are initially connected directly to the first electrode, the electrical separation being performed by severing said at least one selected resistor strip adjacent to the first electrode.

12. A method of adjusting resistance of a heater for a sheet material, the heater comprising: an electrically insulating substrate; and a plurality of resistor strips formed on the substrate to extend side by side between first and second electrodes, all of the resistor strips being initially separated electrically at least from the first electrode; the method comprising:

electrically connecting at least selected one of the resistor strips to the first electrode to obtain a predetermined resistance across the first and second electrodes;

wherein said at least one selected resistor strip is electrically connected to the first electrode by soldering.

13. The method according to claim 12, wherein the respective resistor strips are different in width.

* * * * *